US009090088B2

(12) United States Patent
Sagawa

(10) Patent No.: US 9,090,088 B2
(45) Date of Patent: Jul. 28, 2015

(54) PRINT HEAD AND PRINT APPARATUS

(75) Inventor: Yasumasa Sagawa, Fukushima (JP)

(73) Assignee: Oki Data Corporation, Tokyo (JP)

( * ) Notice: Subject to any disclaimer, the term of this patent is extended or adjusted under 35 U.S.C. 154(b) by 695 days.

(21) Appl. No.: 12/876,521

(22) Filed: Sep. 7, 2010

(65) Prior Publication Data

US 2011/0058877 A1 Mar. 10, 2011

(30) Foreign Application Priority Data

Sep. 9, 2009 (JP) ..... 2009-208700

(51) Int. Cl.
*B41J 2/23* (2006.01)
*B41J 2/27* (2006.01)
*B41J 2/235* (2006.01)

(52) U.S. Cl.
CPC .... *B41J 2/27* (2013.01); *B41J 2/235* (2013.01)

(58) Field of Classification Search
CPC ..... B41J 2/22; B41J 2/27; B41J 2/23; B41J 2/235; B41J 2/255
USPC ..... 400/124.01, 124.17, 124.18, 124.23
See application file for complete search history.

(56) References Cited

U.S. PATENT DOCUMENTS

| | | | | | |
|---|---|---|---|---|---|
| 4,010,836 | A | * | 3/1977 | Bernardis et al. | 400/124.25 |
| 4,023,663 | A | * | 5/1977 | Engler | 400/124.25 |
| 4,582,437 | A | * | 4/1986 | Wang | 400/124.2 |
| 5,033,884 | A | * | 7/1991 | Yamada et al. | 400/124.25 |
| 5,290,113 | A | * | 3/1994 | Andoo et al. | 400/124.17 |
| 5,368,401 | A | * | 11/1994 | Asada et al. | 400/124.21 |
| 5,527,118 | A | * | 6/1996 | Asada et al. | 400/124.24 |
| 6,341,836 | B1 | * | 1/2002 | Koike et al. | 347/20 |

FOREIGN PATENT DOCUMENTS

| | | |
|---|---|---|
| JP | 62-133080 A | 6/1987 |
| JP | 02-133345 A | 5/1990 |
| JP | 04-216958 A | 8/1992 |

* cited by examiner

*Primary Examiner* — David Banh
(74) *Attorney, Agent, or Firm* — Panitch Schwarze Belisario & Nadel LLP

(57) ABSTRACT

Lift of the rotation fulcrum of the armature is prevented. In the print head in which a print wire is furnished at an end portion, and that has an armature that is furnished rotatably, a yoke touches a rotation fulcrum of the armature; an elasticity member of a cantilever structure presses the rotation fulcrum of the armature to the yoke by sandwiching the armature between the yoke and the elasticity member; a housing fixes an end portion of the elasticity member and covers the elasticity member through forming a gap between the elasticity member and the housing; and a pressing member is arranged between the housing and the elasticity member and touches the housing and the elasticity member.

17 Claims, 6 Drawing Sheets

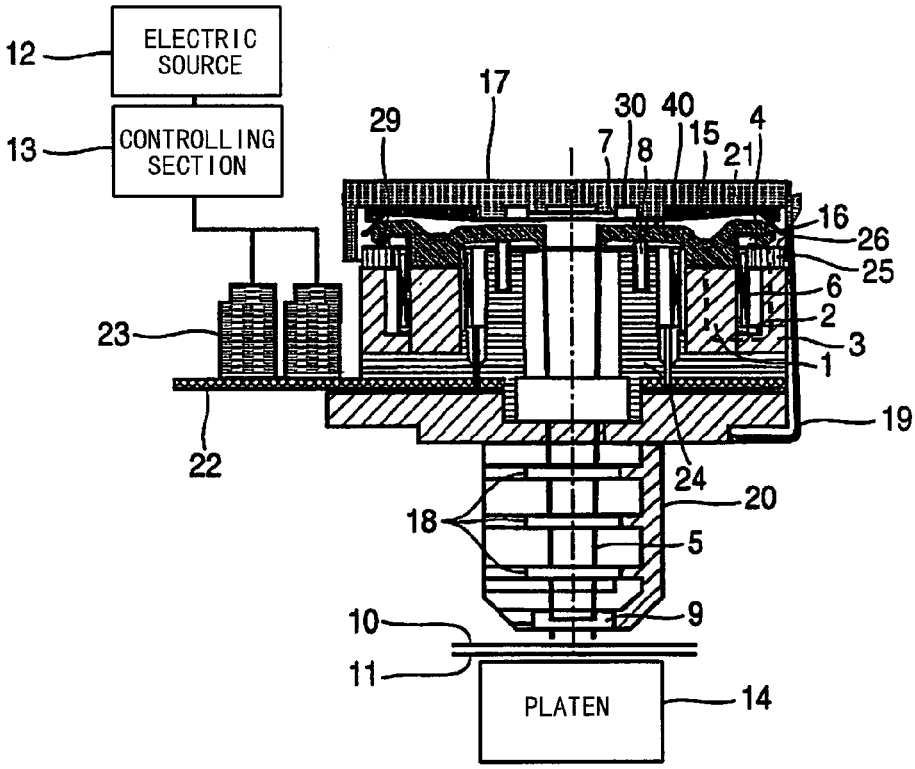
*FIG. 1*
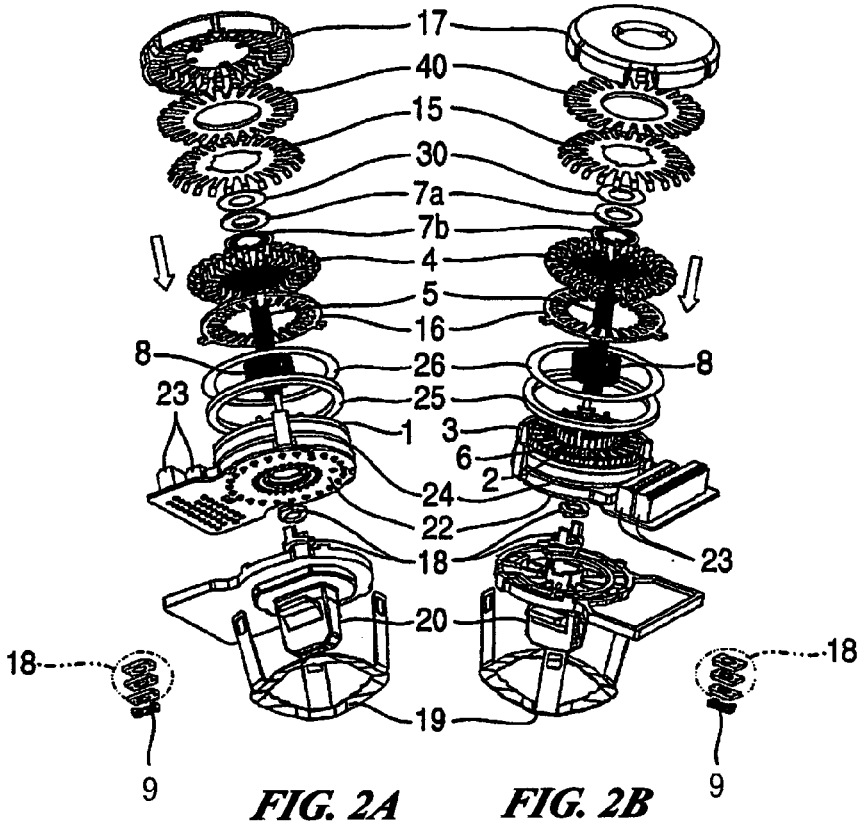
*FIG. 2A* *FIG. 2B*

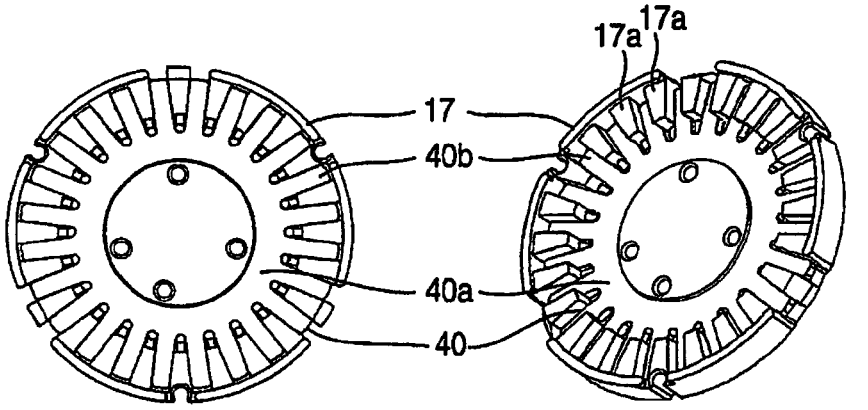
FIG. 3A
FIG. 3B
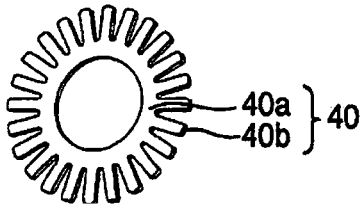
FIG. 3C
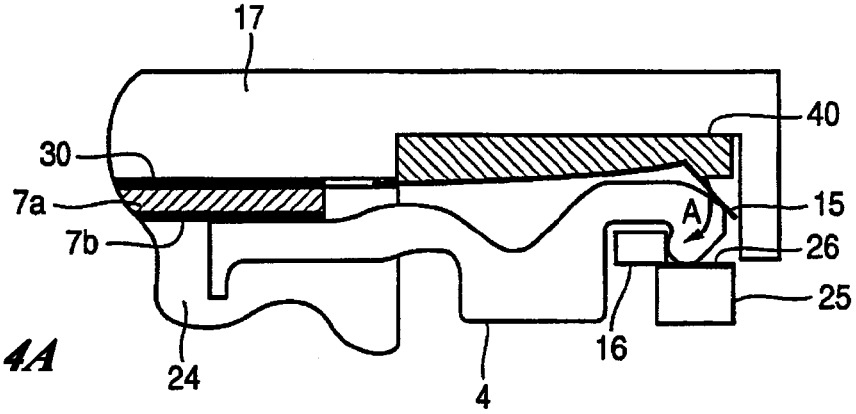
FIG. 4A
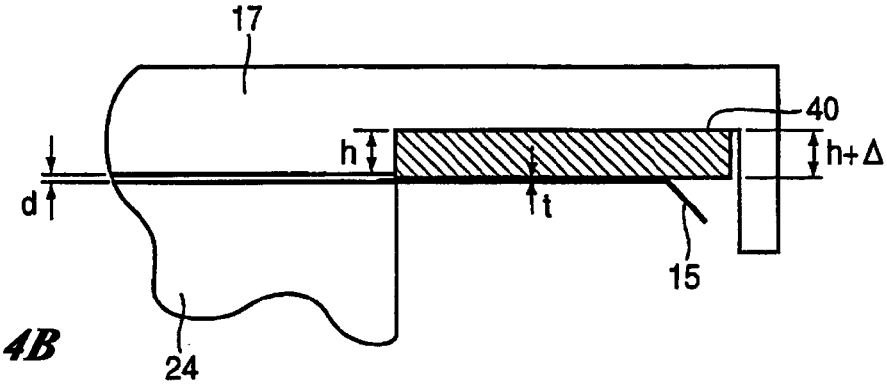
FIG. 4B

PRIOR ART

PRINT HEAD AND PRINT APPARATUS

FIELD OF THE INVENTION

The invention relates to a print head of a dot impact type and a print apparatus comprising the print head.

BACKGROUND OF THE INVENTION

The former SIDM (Serial Impact Dot Matrix) print head (clapper type) (hereinafter: print head) is composed of a plurality of printing element, and it is to explain the structure on the basis of FIG. 10 and FIG. 11.

With respect to FIG. 10, a coil 106 is rolled in an arbitrary turn number around a coil bobbin 102, and a columnar core 101 with a good magnetic property is furnished in the inside. A core yoke 103, a space yoke 125 and a space sheet 126 are furnished by touching the core 101, further, an armature 104 is furnished to face the core 101 across a gap, furthermore, an armature yoke 116 is furnished by touching the space yoke 125 across the armature 104, and these magnetic materials form a magnetic path 121.

The armature 104 is composed of compression spring and the like, is pressed to a limiter portion 107 through a reset spring 108 whose one end is fixed, and a wire 105 is welded to the tip. As shown by FIG. 11, one sheet or a plurality of sheets of spacer 13 is mounted between the limiter portion 107 (rubber limiter 107*a* and sheet limiter 107*b*) and a housing 117, thus, by moving a position of the touching surface of the limiter portion 107 with the armature 104 up and down, a wire stroke of armature 104 is adjusted.

The wire 105 as respective printing elements is positioned through a wire guide 109 fixed in a guide nose 120 so that the tip forms a dot matrix, and a plurality of guides 118 fixed in the guide nose 120 suppress horizontal vibration and buckling of the wire 105.

The reset spring 108 stated above is furnished in a holder spring 124, and makes a pressing force act on the armature 104 to return to a standby position. Further, as shown by FIG. 11, the armature 104 is pressed by a pressure spring 115 to the space yoke 125 surface and the armature yoke 116 surface through the touched space sheet 126, and the touched point becomes a rotation fulcrum 129 around which the armature 104 moves. The pressure spring 115 is fixed on a surface that is formed by the housing 117, and is bent to an arbitrary angle so that the pressing force acts on a fulcrum portion of the armature 104.

After electric power is supplied from an electric source 112 to the coil 106 through a connector 123 on a head substrate 122, magnetic flux is generated in the magnetic path 121, the magnetic flux of the gap between the core 101 that is a part of the magnetic path 121 and the armature 104 acts as attracting force (electromagnetic force) to attract the armature 104 to the core 101 side.

Thus, the wire 105 joined with the armature 104 starts a motion to the direction of a platen 114, impacts on a paper 111 whose back is supported by the platen 114 through an ink ribbon 110, and forms a dot.

After supply of the electric power from the electric source 112 to the coil 106 is stopped, the attracting force is reduced, and when reaction force of the impact and the pressing force of the reset spring 108 to the armature 104 excel the influence of the attracting force, the armature 104 reverses the direction of the motion, and returns to the position of the limiter portion 107. The limiter portion 107 consists of vibration-damping materials or its composite material, and suppresses the remaining vibration of the armature in reset time so that any problem is not caused on responsiveness in the case that dots are formed continuously.

By controlling the series of operation timing through a controlling section 113, it becomes possible to form a character that is an aggregate of dots on the paper 111. Moreover, a clamp spring 119 is a member for making these parts a unit.

The former print head is composed like this.

Further, there is a print head in which a metal reinforcing plate is furnished between a lever holder for holding a lever (armature) and a fixing spring for fastening and holding a head structure member (for example, referring to patent document 1).

Patent document 1: Japan Utility Model Publication of No. 02-133345 (Page 1, FIG. 1)

However, in the former technology stated above, because the shape of the pressure spring that presses the rotation fulcrum of the armature is limited, there is a problem that it is difficult to obtain enough pressing force to completely prevent a lift of the rotation fulcrum of the armature.

The reason why the shape of the pressure spring is limited as stated above is that, because of mounting of the print head, it is difficult to strengthen the pressing force by broadening width through serving petal shaped leaf spring parts as cantilevers respectively. Further, when the pressing force is strengthened by increasing the plate thickness, it enters into a plastic range, and in the case that the irregular load is added, an appropriate pressing force cannot be assigned because the transformed shape does not return to the original one, and it causes the occurrence of the decline of the motion characteristics and the unevenness among the wire.

SUMMARY OF THE INVENTION

It is, therefore, an object of the invention to provide a print head that can solve the above problem. That is, a print head is supplied to prevent the lift of the rotation fulcrum of the armature.

An aspect of the invention is to provide a print head in which a print wire is furnished at an end portion, and that has an armature that is furnished rotatably, comprising: a yoke that touches a rotation fulcrum of the armature; an elasticity member of a cantilever structure that presses the rotation fulcrum of the armature to the yoke by sandwiching the armature between the yoke and the elasticity member; a housing that fixes an end portion of the elasticity member and that covers the elasticity member through forming a gap between the elasticity member and the housing; and a pressing member that is arranged between the housing and the elasticity member and that touches the housing and the elasticity member.

The Effect of the Present Invention

According to the present invention, it is possible to prevent the lift of the rotation fulcrum of the armature.

The above and other objects and features of the present invention will become apparent from the following detailed description and the appended claims with reference to the accompanying drawings.

BRIEF DESCRIPTION OF THE DRAWINGS

FIG. 1 is an outline section diagram showing a structure of a print head of embodiment 1;

FIG. 2A is an exploded perspective diagram showing a structure of a print head of embodiment 1;

FIG. 2B is an exploded perspective diagram showing a structure of a print head of embodiment 1;

FIG. 3A is an explanation diagram showing a structure of a pressure felt of embodiment 1;

FIG. 3B is an explanation diagram showing a structure of a pressure felt of embodiment 1;

FIG. 3C is an explanation diagram showing a structure of a pressure felt of embodiment 1;

FIG. 4A is a section diagram showing a structure of a pressure felt of embodiment 1;

FIG. 4B is a section diagram showing a structure of a pressure felt of embodiment 1;

DETAILED DESCRIPTION OF THE PREFERRED EMBODIMENTS

Figure 5A:
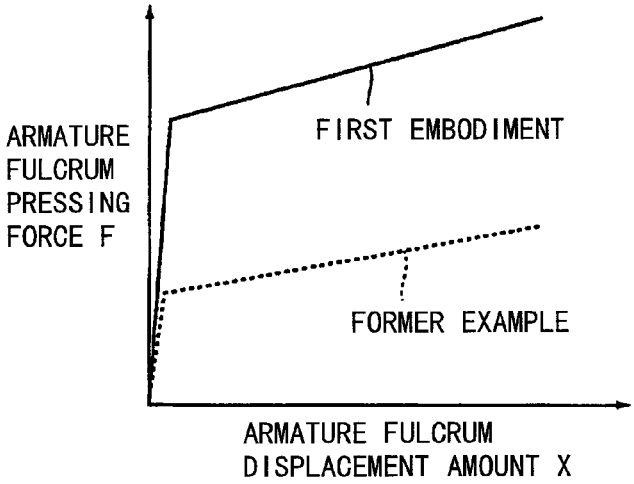
FIG. 5A is a graph showing a relation between an armature fulcrum displacement and a pressing force of embodiment 1.

Embodiments of a print head and a print apparatus of the present invention will be described in detail hereinbelow with reference to the drawings.

<Embodiment 1<

FIG. 1 is an outline section diagram showing a structure of a print head of embodiment 1; FIG. 2A is an exploded perspective diagram showing a structure of a print head of embodiment 1; and FIG. 2B is an exploded perspective diagram showing a structure of a print head of embodiment 1.

With respect to FIG. 1, FIG. 2A and FIG. 2B, a coil 6 is rolled in an arbitrary turn number around a coil bobbin 2, and a columnar core 1 with a good magnetic property is furnished in the inside. A core yoke 3, a space yoke 25 and a space sheet 26 are furnished by touching the core 1, further, an armature 4 is furnished to face the core 1 across a gap, furthermore, an armature yoke 16 is furnished by touching the space yoke 25 across the armature 4, and these magnetic materials form a magnetic path 21.

The armature 4 is composed of compression spring and the like, is pressed to a limiter portion 7 through a reset spring 8 whose one end is fixed, and a wire 5 as a print wire is welded to the tip portion. As shown by FIG. 2A and FIG. 2B, one sheet or a plurality of sheets of spacer 30 is mounted between the limiter portion 7 (rubber limiter 7*a* and sheet limiter 7*b*) and a housing 17, thus, by moving a position of the touching surface of the limiter portion 7 with the armature 4 up and down, a wire stroke of the armature 4 is adjusted.

The wire 5 as respective printing elements is positioned through a wire guide 9 fixed in a guide nose 20 so that the tip forms a dot matrix, and a plurality of guides 18 fixed in the guide nose 20 suppress horizontal vibration and buckling of the wire 5.

The reset spring 8 stated above is furnished in a holder spring 24, and makes a pressing force act on the armature 4 to return to a standby position. Further, the armature 4 is pressed by a pressure spring 15 to the space yoke 25 surface and the armature yoke 16 surface through the touched space sheet 26, and the touched point becomes a rotation fulcrum 29 around which the armature 4 moves, and the armature 4 is formed rotatably.

The pressure spring 15 is a spring member (for example, leaf spring) with cantilever structure, one end portion is fixed on one surface of the housing 17, other end portion is furnished to touch the armature 4 as a free end, and is furnished so as to insert the armature 4 between the space yoke 25 and the armature yoke 16. Further, a bending portion that bends to an arbitrary angle so that the pressing force acts on the rotation fulcrum 29 of the armature 4 is generated in the pressure sprint 15.

The housing 17 sandwiches and fixes one end portion of the pressure spring 15 between the holder spring 24; generates a gap in the intermediate with the pressure spring 15; and covers the whole pressure spring 15.

Further, between the pressure spring 15 that presses the armature 4 and the housing 17, a pressure felt 40, as a pressing member composed of fiber body such as hard felt with small meshes of fiber and the like, is furnished to touch the pressure spring 15 and the housing 17, and through elasticity of the pressure felt 40, furthermore, pressed the pressure spring 15 on the armature 4.

After electric power is supplied from an electric source 12 to the coil 6 through a connector 23 on a head substrate 22, magnetic flux is generated in the magnetic path 21, the magnetic flux of the gap between the core 1 that is a part of the magnetic path 21 and the armature 4 acts as attracting force (electromagnetic force) to attract the armature 4 to the core 1 side.

Thus, the wire 5 joined with the armature 4 starts a motion to the direction of a platen 14, impacts on a paper 11 whose back is supported by the platen 14 through an ink ribbon 10, and forms a dot.

After supply of the electric power from the electric source 12 to the coil 6 is stopped, the attracting force is reduced, and when reaction force of the impact and the pressing force of the reset spring 8 to the armature 4 excel the influence of the attracting force, the armature 4 reverses the direction of the motion, and returns to the position of the limiter portion 7. The limiter portion 7 consists of vibration-damping materials or its composite material, and suppresses the remaining vibration of the armature 4 in reset time so that any problem is not caused on responsiveness in the case that dots are formed continuously.

By controlling the series of operation timing on the basis of a control program (software) stored in a storing section such as a memory and the like that is not shown through a controlling section 13 such as a central processing unit and the like, it becomes possible to form a character that is an aggregate of dots on the paper 11. Moreover, a clamp spring 19 is a member for making these parts a unit.

Here, it is to explain the pressure felt 40 on the basis of explanation diagrams showing a structure of a pressure felt in embodiment 1 of FIG. 3A, FIG. 3B and FIG. 3C, and section diagrams showing a structure of a pressure felt in embodiment 1 of FIG. 4A and FIG. 4B.

In FIGS. 3A-3C, the pressure felt 40 serves material as hard felt with small meshes of fiber, and respective periphery tip parts 40*b* (for example, 24 parts) that extend in petal shapes from a center part 40*a* become to be inserted in a rib 17*a* of the housing 17. Moreover, FIG. 3A is a front diagram of a condition in which a pressure felt is mounted in a housing; FIG. 3B is a perspective diagram of a condition in which a pressure felt is mounted in a housing; and FIG. 3C is a perspective diagram of a pressure felt.

In FIG. 4A and FIG. 4B, the pressure felt 40 is mounted between the housing 17 and the pressure sprint 15 that presses the armature 4 so as to overlap with the pressure spring 15, that is, the thickness of the pressure felt 40 is larger than the distance between the housing 17 and the pressure spring 15, further, the length of the pressure felt 40 becomes almost the same length with the length from a fixed end to a free end of the pressure spring 15, is mounted to press the bending portion of the pressure spring 15.

Further, the pressure felt is soaked with lubricating oil with a good humidity property such as fluorine oil and the like. Furthermore, the space sheet 26 is composed of material with a good wear resistance such as stainless (metal), polyamide (polymer) and the like.

FIG. 4A shows a condition in which an armature is mounted; and FIG. 4B shows a condition in which an armature is not mounted. In FIG. 4B, the plate thickness of the pressure felt 40 is only Δ bigger than the height h of difference of the housing 17, and becomes a thickness (h+Δ). Further, when the plate thickness of the pressure spring 15 is served as t and the gap between the housing 17 and the holder spring 24, in which the pressure spring 15 is sandwiched, is served as d, the sum of the height h of difference of the housing 17 and the gap d between the housing and the holder spring 24 becomes smaller than the sum of the plate thickness (h+Δ) of the pressure felt 40 and the plate thickness t of the pressure spring 15.

That is, there is a relation $h+d<(h+\Delta)+t$, and it becomes $\Delta>d-t$ (backlash).

The Δ is an amount that the pressure felt 40 overlaps with the housing 17 and the pressure spring 15.

Thus, the print head, in which the pressure felt 40 is furnished between the pressure spring 15 and the housing 17, is mounted in a print apparatus such as an impact printer and the like.

It is to explain about the function of the structure stated above.

As shown by FIG. 4A, because the pressure spring 15 is pressed through an elastic force of the pressure felt 40, it presses the armature 4 through enough force. Therefore, the rotation fulcrum portion of the armature 4 is pressed through enough force to the space sheet 26, and its lift is suppressed significantly.

Figure 5B:
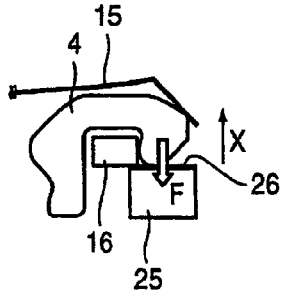
FIG. 5B is a section diagram showing a relation between an armature fulcrum displacement and a pressing force of embodiment 1.

FIG. 5A is a graph showing a relation between an armature fulcrum displacement and a pressing force of embodiment 1, and the pressing forces to the armature 4 are compared between the case of the former type and the case that the pressure felt 40 is furnished in embodiment 1. FIG. 5A serves displacement amount X of fulcrum of an armature shown by FIG. 5B as horizontal axis; and serves pressing force F of fulcrum of an armature shown by FIG. 5B as vertical axis.

Like this, FIG. 5A shows that the force that pressed the armature to the space sheet in the case that the pressure felt 40 is furnished becomes bigger in comparison with the pressing force in the case that the pressure felt 40 is not furnished.

Figure 6A:
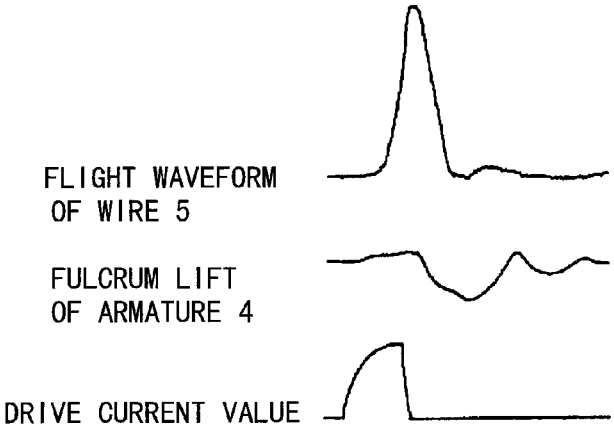
FIG. 6A is a waveform showing an armature fulcrum lift of a former example.
Figure 6B:
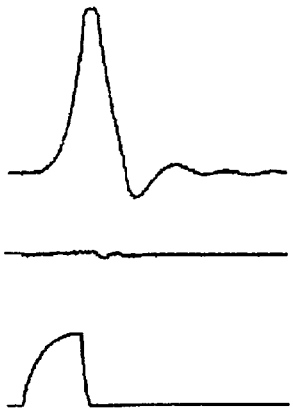
FIG. 6B is a waveform showing an armature fulcrum lift of embodiment 1.
Figure 6C:
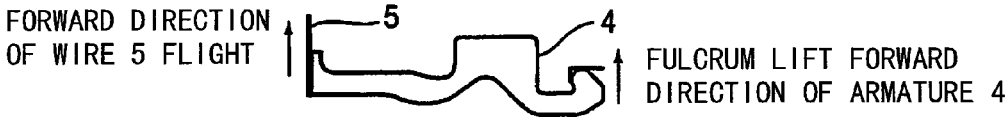
FIG. 6C is a section diagram showing an armature fulcrum lift of embodiment 1.

Further, FIG. 6A and FIG. 6B shows waveform representative of an armature fulcrum lift of embodiment 1 together with flight waveform of a wire 5 and wave form of drive current to the core 1; FIG. 6A shows a former example; and FIG. 6B shown the present embodiment. Moreover, forward direction of wire 5 flight and fulcrum lift forward direction of the armature 4 those are shown by the vertical axes of FIG. 6A and FIG. 6B are shown by FIG. 6C.

As shown by FIG. 6A and FIG. 6B, in the present embodiment, it is possible to significantly suppress the lift of the fulcrum portion of the armature 4. In the former example, the lift of the fulcrum portion of the armature 4 becomes minute vibration coupled with impact cycle of the wire 5 in print head operation time, but in the present embodiment, the minute vibration is suppressed.

Further, as shown by FIG. 4A, the lubricating oil with which the pressure felt 40 is soaked is transmitted on the surface to a direction shown by an arrow A, that is, to the pressure spring 15, the armature 4, the space yoke 25 and the armature yoke 16. Because the center part of the pressure felt 40 has enough volume, it is possible to soak it with enough lubricating oil.

As explained above, in the first embodiment, because the periphery tip parts of the pressure felt restrict rotation fulcrum of the armature in a bigger pressing force compared with the former example as shown by FIG. 5, it is possible to prevent the lift of the rotation fulcrum portion of the armature, and such effect is obtained that minute vibration that occurs in the rotation fulcrum portion can be suppressed.

Further, such effect is obtained that it is possible to reduce pressing wear of the rotation fulcrum portion of the armature together with sliding portions of the space sheet and the armature yoke those touch with the rotation fulcrum portion, which is caused by the minute vibration occurring in the rotation fulcrum portion of the armature.

Furthermore, because enough volume is made in the center parts of the pressure felt, it is possible to soak it with enough lubricating oil, and because the lubricating oil goes is supplied to a sliding surface between the armature and the pressure spring, the space sheet and the armature yoke through passing the periphery tip parts and it becomes boundary (liquid) lubrication, thus a wear resistance effect can be obtained.

Furthermore, because the pressure felt consists of small meshes of felt and the volume is made in its center parts, maintaining performance of the lubricating oil is good and it is possible to stably supply the lubricating oil over time. As a result, it is possible to reduce the wear of the sliding portions for a long time, and such effect is obtained that it is possible to make motion performance such as printing power, speed of the wire and the like stable for a long time and highly durable.

Further, because the pressure felt not only presses the armature through the pressure spring at the periphery tip parts, but also presses the pressure spring in the overlap amount Δ at the center parts, it is possible to absorb backlash between the pressure spring and the gap which is formed by the housing in which the pressure spring is entered and the holder spring, and such effect is obtained that it is possible to suppress unevenness of pressing forces among pins (wires) of the pressure spring and vibration (noise) accompanied by bad restraint.

<Embodiment 2>

It is to explain a structure of embodiment 2 on the basis of a section diagram showing a structure of an armature fulcrum portion in embodiment 2 of FIG. 7.

Figure 7A:
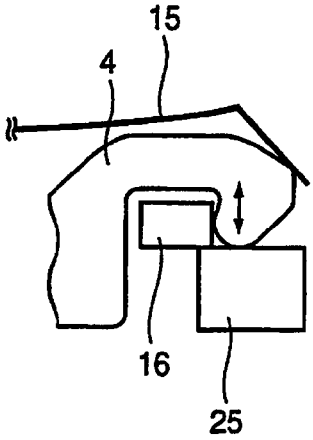
FIG. 7A is a section diagram showing a structure of an armature fulcrum portion of embodiment 2.
Figure 7B:
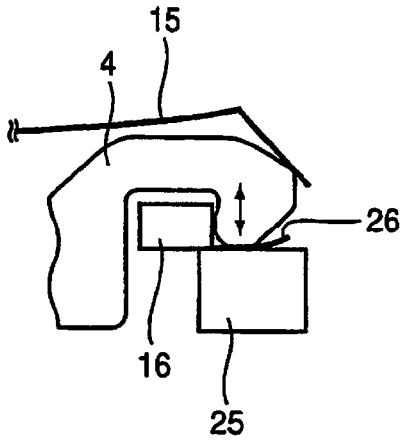
FIG. 7B is a section diagram showing a structure of an armature fulcrum portion of embodiment 2.

The structure of embodiment 2 is constructed by deleting the space sheet 26 from the structure of embodiment 1 shown by FIG. 7B so that the rotation fulcrum of the armature 4 touches the space yoke 25 directly as shown by FIG. 7A. Along with this, hard non-electrolytic nickel boron plating process whose friction coefficient is low is performed to the space yoke 25 and the armature yoke 16.

On the armature 4, non-electrolytic nickel boron plating process and the like may be performed generally, and non-electrolytic nickel boron plating process may also be performed.

Moreover, for the parts those are the same with the embodiment 1 stated above, the explanation is omitted by assigning the same marks.

It is to explain about the function of the structure stated above.

In the former example and the embodiment 1, the space sheet 26 as shown by FIG. 7B is composed of metal foil or resin sheet of about 50 μm, but a warp is easy to occur according to the thinness. When there is the curve, the space sheet 26 becomes an elastic body to make the fulcrum portion of the armature 4 bound (lift), and causes minute vibration.

In the embodiment 2, because the space sheet 26 is deleted as shown by FIG. 7A and the fulcrum portion of the armature 4 directly touches the space yoke 25, it is possible to remove the primary factor to cause the minute vibration, and it is possible to suppress minute vibration that occurs in the fulcrum portion of the armature 4.

Further, according to the non-electrolytic nickel boron plating process to the space yoke 25 and the armature yoke 16 that is performed instead of the space sheet 26, the surfaces of the space yoke 25 and the armature yoke 16 are hardened, and the friction force of the sliding surface with the armature 4 is reduced.

As explained above, in the second embodiment, in addition to the effect of the embodiment 1, such effect is obtained that it is possible to remove minute vibration that can be caused by the warp through poor processing and the like of the space sheet adopted in the embodiment 1 and it is possible to prevent the pressing wear caused by the minute vibration.

Further, because the friction force of the sliding surface between the armature and the space yoke or the armature yoke becomes small according to the non-electrolytic nickel boron plating process, such effect is obtained that it is possible to improve the motion characteristics such as the printing power and the speed of the wire and the like.

Furthermore, according to the low friction coefficient effect and the hardening effect of the non-electrolytic nickel boron plating, it is possible to reduce the wear amount of the space yoke and the armature yoke, and according to corrosion resistance, it is hard to be affected by corrosion (corrosive wear) such as salt damage and the like. Therefore, such effect is obtained that it is possible to make operation of the print head in the embodiment 1 more stable and highly durable.

Furthermore, because the welded parts of the space yoke, the armature yoke, the armature and the wire are not united with other members through adhesion, such effect is obtained that it is possible to maintain and change them per part in the case that these parts are affected by the wear.

<Embodiment 3>

It is to explain a structure of embodiment 3 on the basis of an explanation diagram showing a structure of a housing in embodiment 3 of FIG. 8. Moreover, FIG. 8A is a plane diagram of a housing in embodiment 3; FIG. 8B is a perspective diagram of a housing in embodiment 3; FIG. 8C is a plane diagram of a housing in the former example; and FIG. 8D is a perspective diagram of a housing in the former example.

Figure 8A:
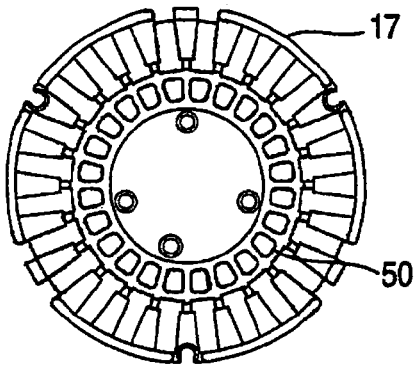
FIG. 8A is an explanation diagram showing a structure of a housing of embodiment 3.
Figure 8B:
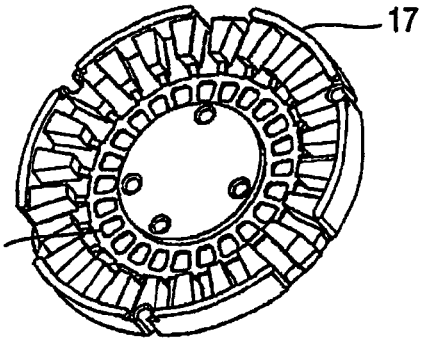
FIG. 8B is an explanation diagram showing a structure of a housing of embodiment 3.
Figure 8C:
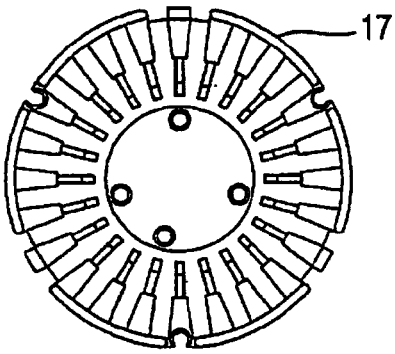
FIG. 8C is an explanation diagram showing a structure of a housing of embodiment 3.
Figure 8D:
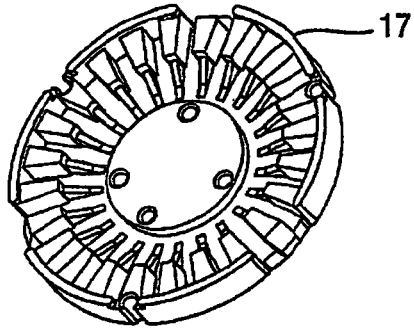
FIG. 8D is an explanation diagram showing a structure of a housing of embodiment 3.

In the structure of embodiment 3, as shown by FIG. 8A and FIG. 8B, an oil reservoir portion (oil storage portion) 50 is formed as a closed space with concave shape on the touching surface with the pressure felt 40 of the housing 17 in the structure of embodiment 1 or embodiment 2. In FIG. 8A and FIG. 8B, a plurality of oil reservoir portions 50 are formed to correspond to respective armatures, but it may also be served as a closed space by connecting them. Further, it may also out oil absorber that is composed of materials like the pressure felt 4 in the oil reservoir portion 50.

Moreover, for the parts those are the same with the embodiment 1 and the embodiment 2 stated above, the explanation is omitted by assigning the same marks.

It is to explain about the function of the structure stated above.

Figure 9:
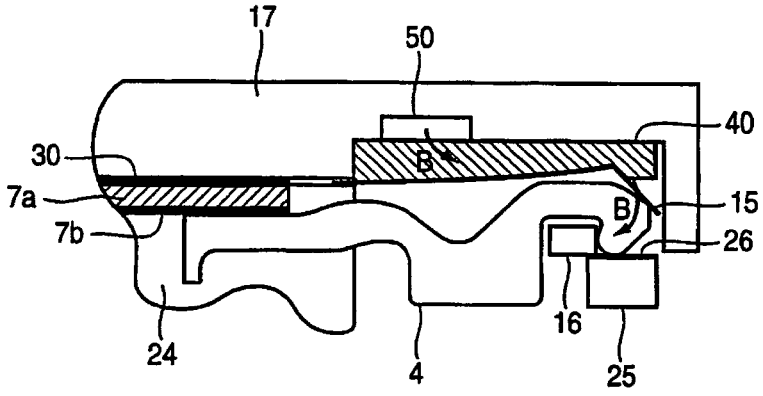
FIG. 9 is a section diagram showing a structure of a pressure felt of embodiment 3.
Figure 10:
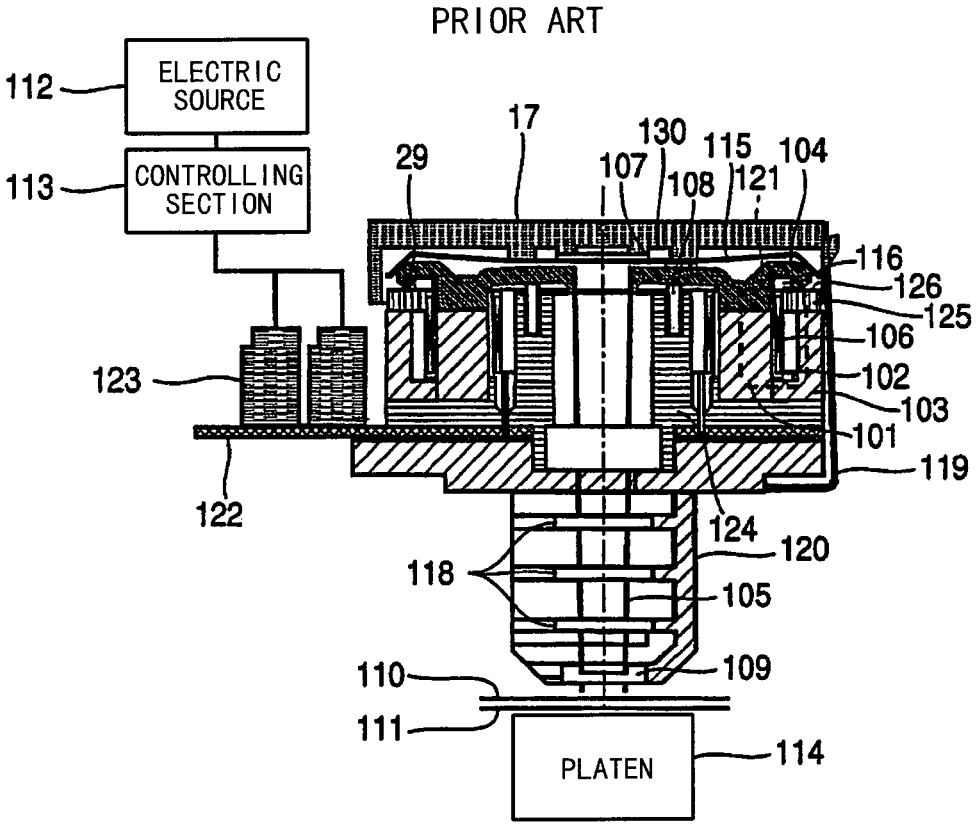
FIG. 10 is an outline section diagram showing a structure of a print head in a former example.
Figure 11:
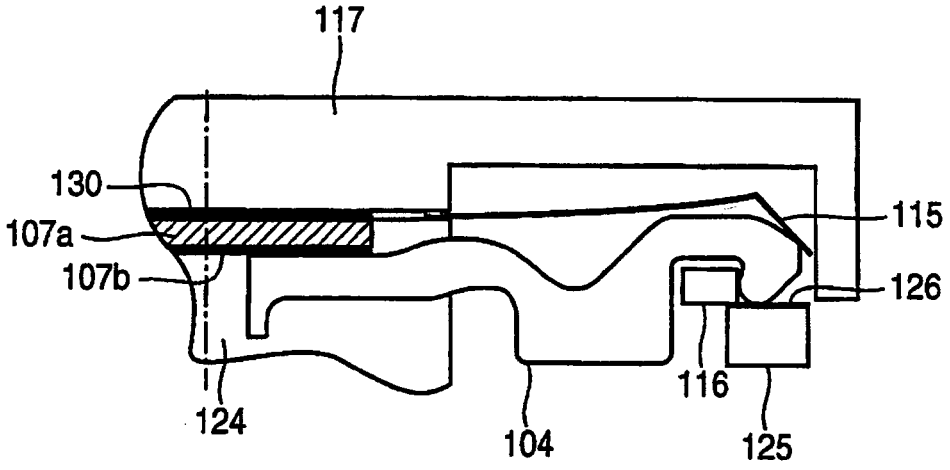
FIG. 11 is a main part section diagram showing a structure of a print head in a former example.

FIG. 9 is a section diagram showing a structure of a pressure felt of embodiment 3.

Through forming the oil reservoir portion 50 as a concave closed space on the touching portion with the pressure felt 40 of the housing 17, it is possible to accumulate larger amount of lubricating oil than the amount absorbed in the pressure felt 40 by using the oil reservoir portion 50.

As shown by FIG. 9, the lubricating oil accumulated in the oil reservoir portion 50 is transmitted on the surface to a direction shown by an arrow B in the drawing, that is, to the pressure felt 40, the pressure spring 15, the armature 4, the space yoke 25 and the armature yoke 16.

As explained above, in the third embodiment, in addition to the effect of the embodiment 1 and the embodiment 2, through forming an oil reservoir portion, it is possible to increase total amount of the lubricating oil by accumulating larger amount of the lubricating oil than the amount absorbed in the pressure felt. Therefore, such effect is obtained that it is possible to lengthen the supply time of the lubricating oil to the sliding portions of the respective parts with the armature, furthermore, it is possible to make the print head highly durable.

The present invention is not limited to the foregoing embodiments but many modifications and variations are possible within the spirit and scope of the appended claims of the invention.

What is claimed is:

1. A print head in which a print wire is furnished at an end portion, and that has an armature that is furnished rotatably, comprising:

a yoke that touches a rotation fulcrum of the armature;

an elasticity member of a cantilever structure that presses the rotation fulcrum of the armature to the yoke by sandwiching the armature between the yoke and the elasticity member;

a housing that fixes an end portion of the elasticity member and that covers the elasticity member through forming a gap between the elasticity member and the housing; and a pressing member that is arranged between the housing and the elasticity member, the armature comprised of a plurality of armatures and the pressing member including a center part and periphery tip parts, the periphery tip parts corresponding to the plurality of armatures, respectively, the periphery tip parts having a thickness one of equal to and larger than a distance between the housing and the elasticity member such that the periphery tip parts touch the housing and the elasticity member in a mounted configuration, the periphery tip parts configured to press the elasticity member onto the plurality of armatures, respectively.

2. The print head according to claim 1, wherein the pressing member is soaked with lubricating oil.

3. The print head according to claim 2, wherein an oil storage portion with concave shape is formed on a surface facing the pressing member.

4. The print head according to claim 3, wherein the oil storage portion is formed in the housing on a position opposite to the plurality of armatures between the rotation fulcrum of the respective plurality of armatures and the print wire.

5. The print head according to claim 4, wherein the oil storage portion formed in the housing is furnished in a connecting portion of the pressing member.

6. The print head according to claim 5, wherein the pressing member consists of felt.

7. The print head according to claim 6, wherein the periphery tip parts extend in petal shapes from the center part.

8. The print head according to claim 1, wherein the yoke, on whose surface non-electrolytic nickel boron plating process is performed, touches the rotation fulcrum of the armature on a surface.

9. The print head according to claim 1, wherein the rotation fulcrum of the armature is located on an opposite end side of the armature with respect to an installation position of the print wire.

10. The print head according to claim 9, wherein the elasticity member and the armature touch at the rotation fulcrum side, and have a gap between the elasticity member and the armature in a direction of the print wire separated from the rotation fulcrum.

11. The print head according to claim 1, wherein the print wire operates as a point of action of the armature.

12. The print head according to claim 11, wherein the armature has a point of effort between the print wire and the fulcrum.

13. The print head according to claim 12, further comprising:

a core and a coil that become magnetic if they are charged with electricity on a position opposite to the point of effort of the armature.

14. A print apparatus that has a print head in which a print wire is furnished at an end portion, and which has an armature that is furnished rotatably, wherein the print head, comprising:

a yoke that touches a rotation fulcrum of the armature;

an elasticity member of a cantilever structure having an end portion and a bending portion that presses the rotation fulcrum of the armature to the yoke by sandwiching the armature between the yoke and the elasticity member, the elasticity member having a fixed end proximate the end portion and a free end proximate the bending portion, the fixed end and the free end defining an elasticity member length;

a housing that fixes the fixed end of the elasticity member and that covers the elasticity member through forming a gap between the elasticity member and the housing, the gap having a gap length; and a pressing member that is arranged between the housing and the elasticity member, the pressing member including a center part and periphery tip parts, the periphery tip parts positioned in the gap and touching the housing and bending portion of the elasticity member, the periphery tip parts configured to press the elasticity member onto the armature, the periphery tip parts having a pressing member length that is substantially the same as the elasticity member length and the gap length.

15. A print head in which a print wire is furnished at an end portion, and that has an armature that is furnished rotatably, comprising:

a yoke that touches a rotation fulcrum of the armature;

an elasticity member of a cantilever structure that presses the rotation fulcrum of the armature to the yoke by sandwiching the armature between the yoke and the elasticity member, the elasticity member having a fixed end, a free end, an end portion proximate the fixed end and a bending portion proximate the free end;

a housing that fixes the fixed end and the end portion of the elasticity member and that covers the elasticity member through forming a gap between the elasticity member and the housing; and a pressing member that is arranged between the housing and the elasticity member and that touches the housing and the elasticity member, the pressing member including a center part and periphery tip parts that extend in petal shapes from the center part, the periphery tip parts touching the bending portion of the elasticity member, the periphery tip parts having a thickness one of equal to and larger than a height of the gap and being mounted in the gap in a mounted configuration such that the periphery tip parts touch an upper surface of the bending portion of the elasticity member and a lower surface of the housing.

16. The print head according to claim 15, wherein the pressing member is soaked with lubricating oil.

17. The print head according to claim 15, wherein the pressing member consists of felt.

* * * * *